US009511377B2

(12) United States Patent
Zhang et al.

(10) Patent No.: US 9,511,377 B2
(45) Date of Patent: Dec. 6, 2016

(54) HIGH GRADIENT, OIL-COOLED IRON REMOVAL DEVICE WITH INNER CIRCULATION

(71) Applicant: LONGI MAGNET CO., LTD., Fushun, Liaoning (CN)

(72) Inventors: Chengchen Zhang, Fushun (CN); Chengwu Zhang, Fushun (CN); Nengping Zhao, Fushun (CN); Hongxu Li, Fushun (CN); Ylng Zhao, Fushun (CN); Shikuan Bi, Fushun (CN); Wenbo Yu, Fushun (CN)

(73) Assignee: LONGI MAGNET Co., Ltd., Fushun, Liaoning (CN)

( * ) Notice: Subject to any disclaimer, the term of this patent is extended or adjusted under 35 U.S.C. 154(b) by 50 days.

(21) Appl. No.: 14/377,070

(22) PCT Filed: Dec. 26, 2012

(86) PCT No.: PCT/CN2012/087502

§ 371 (c)(1),
(2) Date: Aug. 6, 2014

(87) PCT Pub. No.: WO2013/107257

PCT Pub. Date: Jul. 25, 2013

(65) Prior Publication Data

US 2015/0014224 A1 Jan. 15, 2015

(30) Foreign Application Priority Data

Jan. 19, 2012 (CN) ..... 2012 1 0016385

(51) Int. Cl.
*B03C 1/031* (2006.01)
*B03C 1/033* (2006.01)
(Continued)

(52) U.S. Cl.
CPC ..... *B03C 1/031* (2013.01); *B03C 1/002* (2013.01); *B03C 1/025* (2013.01); *B03C 1/035* (2013.01);
(Continued)

(58) Field of Classification Search
CPC ..... B03C 1/025; B03C 1/031; B03C 1/0205; B03C 1/02; B03C 1/288; B03C 1/28; B03C 1/0335; B03C 1/033; B03C 1/002; B03C 1/035; B03C 2201/18; H01F 6/04; H01F 6/06; H01F 27/008; H01F 27/08; H01F 27/10; H01F 27/12; H01F 27/14; H01F 27/2876; H01F 27/32; H01F 27/322; H01F 27/324; H01F 3/00–3/14; H01F 27/346; H01F 27/33; H01F 27/28; H01F 27/24
(Continued)

(56) References Cited

U.S. PATENT DOCUMENTS 1,815,707 A * 7/1931 Gerth ..... H01F 30/16 336/198
3,579,162 A * 5/1971 Savkar ..... H01F 27/322 165/104.31
(Continued)

FOREIGN PATENT DOCUMENTS

CN 2668265 Y 1/2005
CN 101234364 A 8/2008
(Continued)

OTHER PUBLICATIONS

Written Opinion of the International Searching Authority (WOISA) Apr. 4, 2013.*
CN 101234364 STIC translation.*

*Primary Examiner* — David C Mellon
*Assistant Examiner* — Liam Royce
(74) *Attorney, Agent, or Firm* — Andrew W. Chu; Craft Chu PLLC

(57) ABSTRACT

A high-gradient internal-circulating oil-cooled Magnetic Separator, includes magnetic system coils, an internal-circulating oil path system, an external-cooling system and an oil conservator. The magnetic system coils are used for generating excitation magnetic field to achieve the iron-
(Continued)

absorption function, the magnetic paths of the magnetic system coils being an open magnetic path structure. The internal-circulating oil path system is used for allocation and collection circulation of transformer oil. The external-cooling system is used for heat dissipation of transformer oil to achieve internal heat dissipation balance. The oil conservator is used as a supplementary container for the transformer oil expansion during the apparatus's operation. An internal-circulating structure is employed, and external-circulating pipes are simplified, circulating resistance in oil paths being reduced, problems including complex interference in oil paths arrangement, low circulation efficiency, leakage at welding spots, etc. being avoided, ensuring normal operation, and enhancing efficiency of iron removing.

4 Claims, 11 Drawing Sheets

(51) Int. Cl.

| | |
|---|---|
| ***B03C 1/28*** | (2006.01) |
| ***B03C 1/00*** | (2006.01) |
| ***B03C 1/025*** | (2006.01) |
| ***B03C 1/035*** | (2006.01) |
| ***H01F 27/32*** | (2006.01) |
| ***H01F 27/28*** | (2006.01) |
| ***H01F 27/12*** | (2006.01) |
| ***H01F 27/34*** | (2006.01) |
| ***H01F 27/33*** | (2006.01) |
| ***H01F 27/14*** | (2006.01) |
| ***H01F 27/24*** | (2006.01) |

(52) U.S. Cl.
CPC ..... *B03C 1/0335* (2013.01); *B03C 1/28* (2013.01); *B03C 1/288* (2013.01); *B03C 2201/18* (2013.01); *H01F 27/12* (2013.01); *H01F 27/14* (2013.01); *H01F 27/24* (2013.01); *H01F 27/28* (2013.01); *H01F 27/2876* (2013.01); *H01F 27/32* (2013.01); *H01F 27/324* (2013.01); *H01F 27/33* (2013.01); *H01F 27/346* (2013.01)

(58) Field of Classification Search
USPC ..... 210/167.03, 222, 695
See application file for complete search history.

(56) References Cited

U.S. PATENT DOCUMENTS

| | | | | |
|---|---|---|---|---|
| 3,934,453 | A * | 1/1976 | Hessen | H01F 27/14 174/11 R |
| 4,156,221 | A * | 5/1979 | Graul | H01F 19/02 336/234 |
| 4,257,025 | A * | 3/1981 | Hareland | H01F 27/346 336/178 |
| 4,521,954 | A * | 6/1985 | Rademaker | H01F 27/085 29/605 |
| 8,081,054 | B2 * | 12/2011 | Guentert, III | H01F 27/12 336/58 |
| 2003/0089238 | A1 * | 5/2003 | Viereck | H01F 27/14 96/111 |
| 2013/0147588 | A1 * | 6/2013 | Sarver | H01F 27/245 336/5 |

FOREIGN PATENT DOCUMENTS

| | | | |
|---|---|---|---|
| CN | 202078961 | U | 12/2011 |
| CN | 102553711 | A | 7/2012 |
| CN | 202427552 | U | 9/2012 |
| KR | 20030013001 | A | 2/2003 |
| KR | 100432535 | B1 | 5/2004 |

* cited by examiner

HIGH GRADIENT, OIL-COOLED IRON REMOVAL DEVICE WITH INNER CIRCULATION

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

This invention relates to the field of magnetic separation machinery, specifically pertaining to the field of Magnetic Separator technology, particularly relating to a high-gradient internal-circulating oil-cooled Magnetic Separator.

2. Description of Related Art Including Information Disclosed Under 37 CFR 1.97 and 37 CFR 1.98

Magnetic Separators have been widely used in magnetic separation. Magnetic Separators are not only applicable for coal handling systems in power plants, but also for organizations and places including beneficiation plants, sugarhouses, ceramic works, and so on, where ferromagnetic substance requires to be separated. For example, a plate-type Magnetic Separator to absorb ferromagnetic substance in material using permanent magnetic force was disclosed in the Chinese patent application numbered 922344.3. It included an I-shaped rail, an electromotive car and a box. A permanent magnetic steel was set inside the box, a main motor, a turbine and a worm transmission mechanism being set above the box, a subsidiary motor being set on both left and right side walls of the box, transmission gears engaging lead-screw gears on the output axis of a subsidiary motor, sliding nuts on the parallel lead screws driving the open and close of the screen door. However, performance drop was easily led to by overheating due to the fact that Magnetic Separators work under hostile environment and that they themselves accumulate a lot of heat because of electromagnetic consumption.

Thereafter, circulating air-cooled Magnetic Separators and circulating oil-cooled Magnetic Separators appeared. Circulating oil-cooled Magnetic Separators have now been widely used in industries including coal, power and port, etc. due to their characteristics including small dimension, light weight, low temperature rise, etc. Frequently used circulating oil-cooled Magnetic Separators at present are all with external-circulating structures, there being many bends in oil circuit design, which interferes with each other, making it difficult to be arranged. There are also a few electromagnetic Magnetic Separators of the oil-cooled internal-circulating type in prior art. For example, an internal oil-cooled type electromagnetic Magnetic Separator in a fire-new cooled way was disclosed by the Chinese patent application numbered 200910300752.9, which comprises an electromagnetic magnetic system, a power pump, an oil tank, a heat exchanger and an electrical control system, wherein the electromagnetic magnetic system comprises cooling medium which is sealed by an internal magnetic pole, an external magnetic pole and a yoke plate and is used for cooling ohm heat generated by a coil; the coil being wound by a hollow pipe, and the hollow pipe being a cooling channel of the internal-cooled type electromagnetic Magnetic Separators, the cooling medium being circulated in the hollow pipe for cooling; the cooling medium being transported to the electromagnetic magnetic system for being circulated to cool the coil by the power pump; the electromagnetic system, the power pump, the oil tank, the heat exchanger and the electrical control system employing loose connection mode, wherein the electromagnetic magnetic system being equipped with a cooling medium inlet and outlet pipe, and the power pump, the oil tank and the heat exchanger being connected with a pipeline outside the electromagnetic magnetic system in series.

The rational layout of the internal-circulating oil paths relates directly to the temperature rise and performance of the Magnetic Separators in oil internal-cooled electromagnetic Magnetic Separators. Therefore, research on how to set rationally has been a hot topic for engineers in recent years.

SUMMARY OF THE INVENTION

With respect to the above circumstances, a high-gradient internal-circulating oil-cooled Magnetic Separator is put forward by the inventors throughout times of design and study. External-circulating oil paths are replaced by internal-circulating oil paths in the invention, while being capable of enhancing uniformity of transformer oil circulating in magnetic coils, decreasing resistance in pipelines, and increasing efficiency in circulation.

A high-gradient internal-circulating oil-cooled Magnetic Separator is provided according to the technical scheme of the invention. The high-gradient internal-circulating oil-cooled Magnetic Separator comprises magnetic system coils 4, an internal-circulating oil path system 3, an external-cooling system 2 and an oil conservator 1, wherein the magnetic system coils 4 is used for generating excitation magnetic field to achieve the iron-absorption function of the Magnetic Separator, the magnetic paths of the magnetic system coils 4 being an open magnetic path structure; the internal-circulating oil path system 3 is used for allocation and collection circulation of the transformer oil; the external-cooling system 2 is used for heat dissipation of the transformer oil to achieve internal heat dissipation balance of the high-gradient internal-circulating oil-cooled Magnetic Separator; the oil conservator 1 is used as a supplementary container for the transformer oil expansion during the apparatus's operation; the magnetic system coils 4 comprises multiple groups of energized coils 5 composed of several windings, a round insulating rod 6 being used as a heat dissipation oil path to separate two windings, an insulating positioning board 9 being used to secure the round insulating rod 6; an insulating block 7 and a bending board 8 being to secure coils and circulate the oil paths; the oil path being one part of oil-return channels, coils being slipped over a core 11.

Among the rest, the internal-circulating oil path system 3 comprises a core 11 on which coils are wound, an oil conduit yoke plate 12, a large yoke plate 13, a magnet-conductive tube 14, a large supporting plate 15, and a supporting plate 16; wherein the core 11 is used to allocate and collect the transformer oil, the core 11 being at the middle position of the internal-circulating oil path system, the core 11 directing the excitation provided by the coils 5 to the bottom of the Magnetic Separator to provide an open magnetic field for the Magnetic Separator; the coils 5 being wound on the core 11, the core 11 directing the excitation provided by the coils 5 to the bottom of the Magnetic Separator to provide an open magnetic field for the Magnetic Separator; the oil conduit yoke plate 12 and the large yoke plate 13 are welded in sequence on the upper part of the core 11; magnetic force lines above the core 11 are directed back to the core 11, increasing the magnetic field under the magnetic separator and decreasing flux leakage of the magnetic separator; the supporting plate 16 and the large supporting plate 15 are welded in sequence on the lower part of the core 11, taking part in securing the magnetic system; after coiling on the core in the magnetic system coils 4, the supporting plate 16 and the large supporting plate 15, the large yoke plate 13 and the oil conduit yoke plate 12 are welded to the magnet-conductive tube 14 to constitute a sealed container; an oil-inlet through-hole is set inside the core 11, radially diverging oil-collecting slots being formed on the upper and lower part of the core 11 by mechanical process; an oil-return hole and an oil-inlet hole are set on the large yoke plate 13 and the oil conduit yoke plate 12, the oil-inlet hole of the large yoke plate 13 and the oil conduit yoke plate 12 being connected with the oil-inlet hole of the core 11, the oil-return holes of the large yoke plate 13 and the oil conduit yoke plate 12 being connected with the oil-collecting slots above the core 11; transformer oil enters an oil-inlet through hole of the core 11 through the oil-inlet hole on the large yoke plate 13 and the oil-inlet hole on the oil conduit yoke plate 12, and then the transformer oil is injected into the coils 5 from the oil-collecting slots on the bottom of the core 11, moving bottom up to achieve heat dissipation of the coils 5.

In addition, the external-cooling system 2 comprises an oil pump 21 and a cooler 19, wherein the oil pump 21 connects with the oil-outlet tube 17 on one side, the other side of the oil pump 21 connecting with the cooler 19; the oil pump 21 is used for accelerating circulation of the transformer oil, enhancing the heat dissipation effect of the transformer oil to coils 5. The oil-outlet tube 17 connects with the oil-return hole of the large yoke plate 13 in the internal-circulating oil path system 2, the transformer oil in the oil-outlet tube 17 being injected into the cooler 19 by the oil pump 21, the other side of the cooler 19 connecting with the oil-inlet tube 18; transformer oil is injected into the oil-inlet hole of the large yoke plate 13 in the internal-circulating system 2 through the oil-inlet tube 18 after being cooled by the cooler 19, and continues repeatedly to achieve heat dissipation of the coils 5.

Preferably, the oil conservator 1 comprises an oil conservator body 22, a liquid level box 23, an excitation junction box 24, and a moisture absorber 25. The oil conservator 1 is used as a supplementary container for the transformer oil expansion during the apparatus's operation. The conservator body 22 connects with the oil paths of the magnetic separator through two vertical pipes, serving as an oil storage container of the oil conservator 1; the liquid level box 23 is located at the midpoint under the oil conservator 1, achieving liquid level alerting through a floater liquid level switch; the excitation junction box 24 is located above the oil conservator 1; the moisture absorber 25 is located under the oil conservator 1, one bending tube being used to connect the moisture absorber with the conservator body 22, one side of the bending tube being deep into the conservator body 22.

Further, transformer oil at low temperature comes from oil-inlet holes, transformer oil spraying out of the bottom of the core 11 after passing bottom up the core 11 in which an oil-inlet through hole exists, providing uniformly to the excitation coils 5 for heat exchange preparation; transformer oil enters uniformly multiple-layered winding coils 5 to start heat exchange bottom up; hot oil coming out of coils gaps is collected at the oil-return hole through the oil-collecting slots on the core 11, thus far accomplishing one heat exchanging internal-circulating process.

Furthermore, the hot transformer oil coming out of the oil-outlet tube of the external-cooling system backflows to the cooler 19, heat being dissipated to air by fans; accomplish one complete circulation process.

Because an internal-circulating structure is employed in the invention, external-circulating pipes are simplified, circulating resistance in the oil paths being reduced, problems including complex interference in oil paths arrangement, low circulation efficiency, leakage at welding spots, etc. being avoided, ensuring normal operation of the magnetic separator, enhancing the efficiency of iron removing. Meanwhile, this internal-circulating structure makes the oil paths circulation more uniform and reasonable, decreasing effectively the temperature rise of the magnetic separator, ensuring the temperature rise be under 40° C., enhancing performance of the magnetic separator, making its performance much higher than the industrial standard. In addition, an oil-inlet through hole is set in the core 11, and the core may be cooled when oil is injected, making the whole heat dissipation effect of the Magnetic Separatorentire Magnetic Separator better. The structure in the invention is simple, the design being reasonable, making it convenient for maintenance. The invention fills in gaps in magnetic separators of this kind, leads at an advanced level of the oil-cooled magnetic separators, and is worthy of application and dissemination.

DETAILED DESCRIPTION OF THE DRAWINGS

The technical scheme of the invention will be described below in detail in connection with the accompanying drawings. The description below is only described as examples. The skilled person in the art clearly knows that any method or system conforming to the idea of the invention should all falls into the scope of the invention. In addition, the scope of the invention should not be limited only to the following specific structures or parts or detailed parameters.

The central body of the high-gradient internal-circulating oil-cooled Magnetic Separator is the magnetic system. The high-gradient internal-circulating oil-cooled Magnetic Separator may be divided into four functional modules: magnetic system coils 4, an internal-circulating oil path system 3, an external-cooling system 2, and an oil conservator 1, wherein the magnetic system coils 4 is used for generating excitation to achieve the iron-absorption function of the Magnetic Separator, the magnetic paths of the magnetic system coils 4 being an open magnetic path structure; the internal-circulating oil path system 3 is used for allocation and collection circulation of the transformer oil; the external-cooling system 2 is used for heat dissipation of the transformer oil to achieve internal heat dissipation balance of the high-gradient internal-circulating oil-cooled Magnetic Separator; the oil conservator 1 is used as a supplementary container for the transformer oil expansion during the apparatus's operation.

Figure 1:
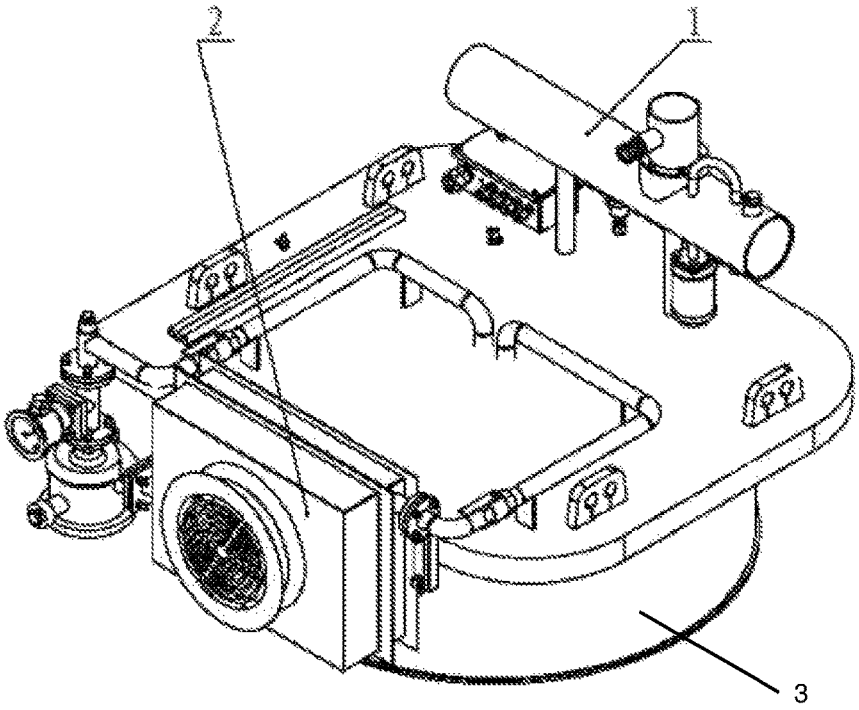
FIG. 1 is a schematic view of the overall structure of the high-gradient internal-circulating oil-cooled magnetic separator according to the invention.
Figure 2:
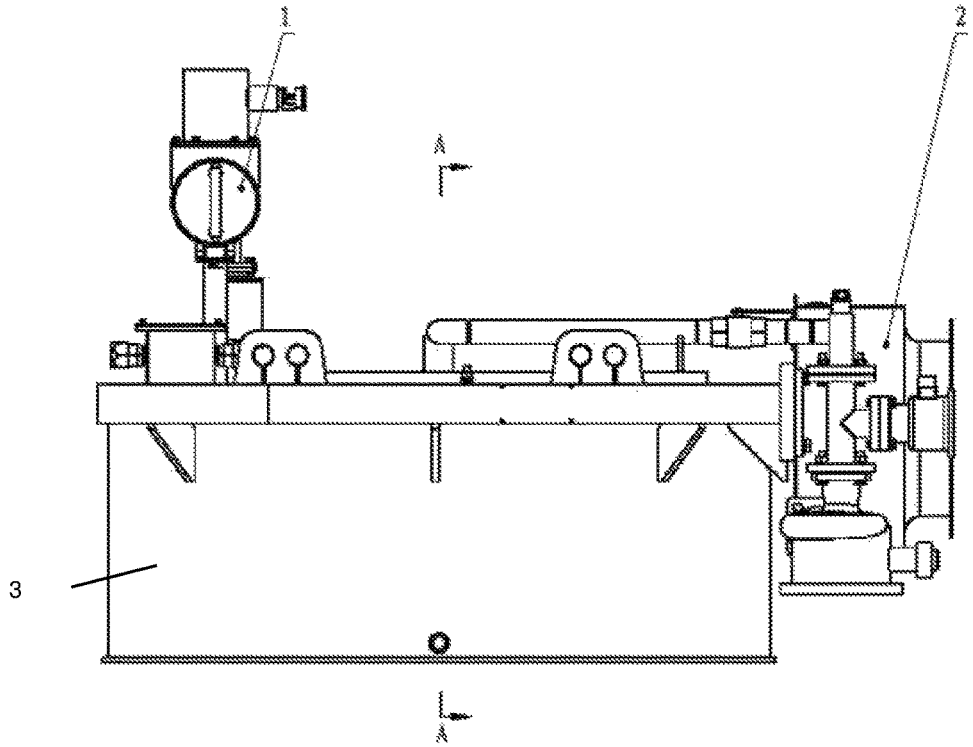
FIG. 2 is a front view of the high-gradient internal-circulating oil-cooled magnetic separator according to the invention.
Figure 3:
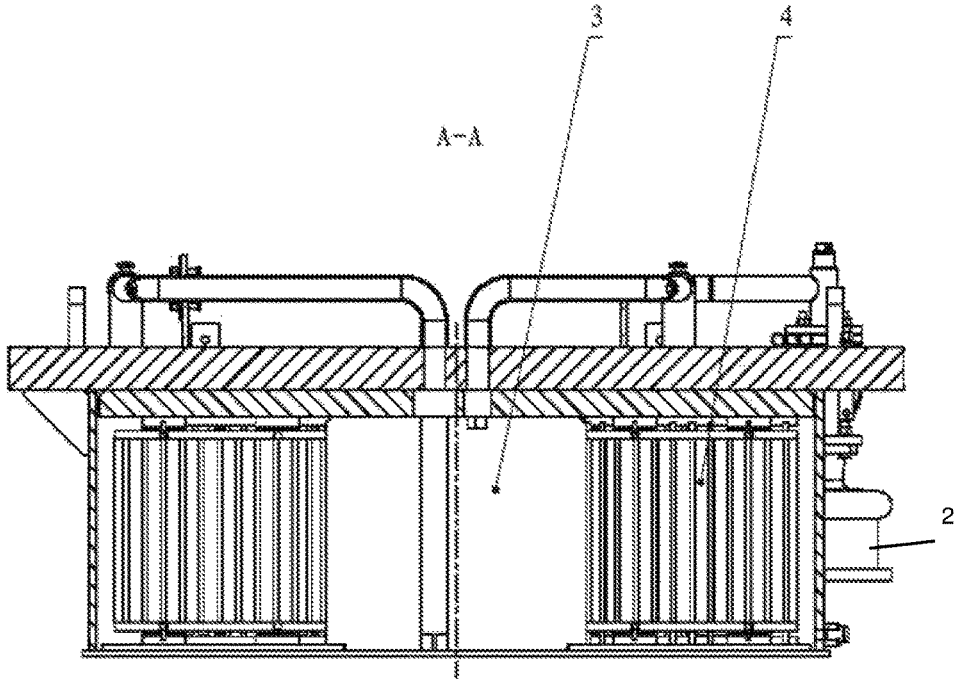
FIG. 3 is an A-A sectional view of the high-gradient internal-circulating oil-cooled magnetic Separator shown in FIG. 2.
Figure 4:
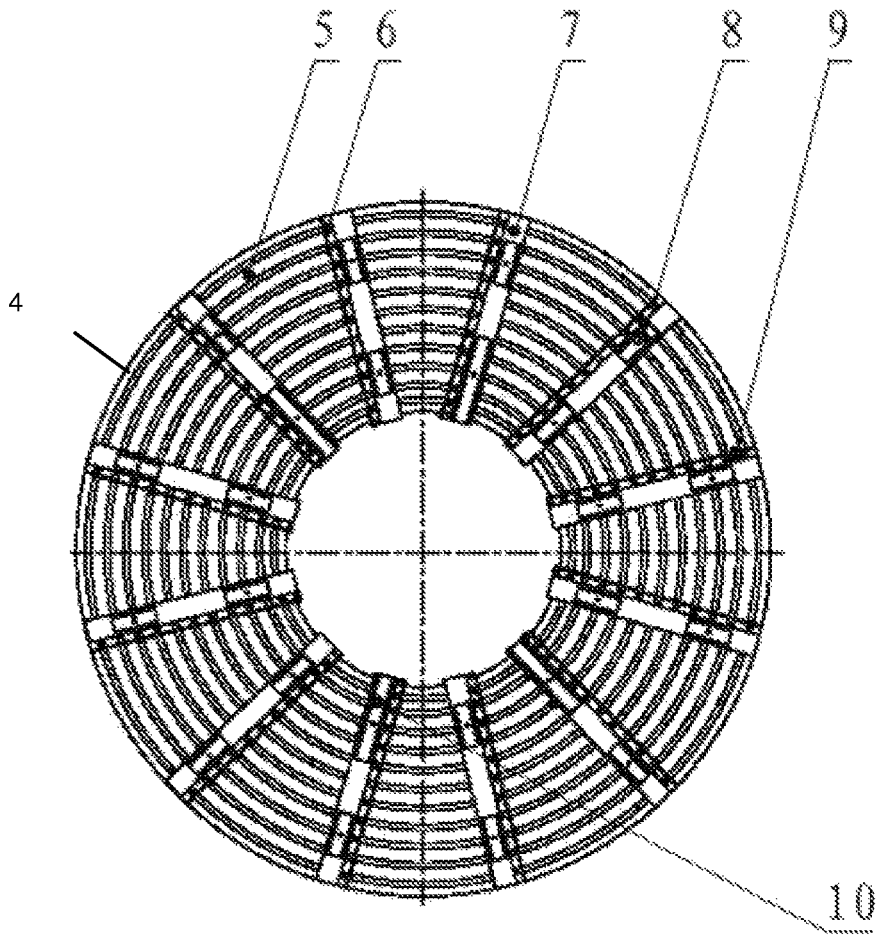
FIG. 4 is a top view of the magnetic system coils in the high-gradient internal-circulating oil-cooled magnetic Separator shown in FIG. 2.
Figure 5:
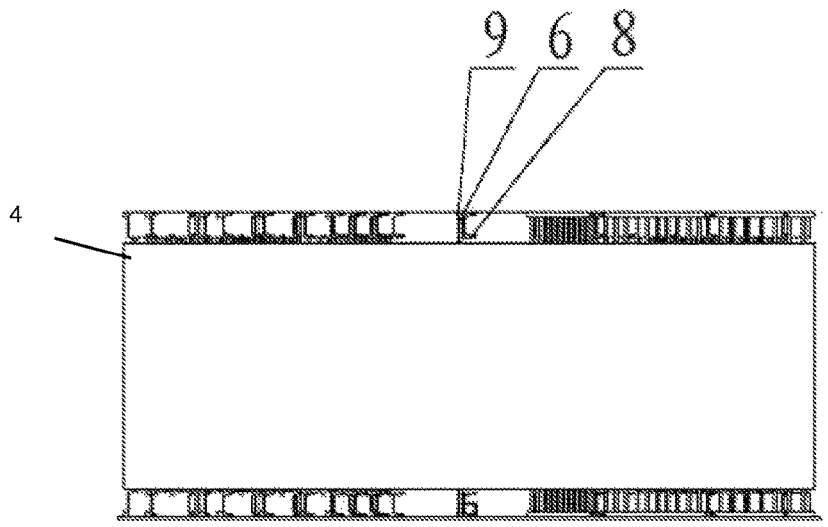
FIG. 5 is a front view of the magnetic system coils in the high-gradient internal-circulating oil-cooled magnetic Separator shown in FIG. 2.

As shown in FIG. 4 and FIG. 5, FIG. 4 is a top view of the magnetic system coils, and FIG. 5 is a front view of the magnetic system coils. The magnetic system coils 4 mainly comprises energized coils 5, generating excitation to achieve the iron-absorption function of the Magnetic Separator. Coils 5 may be divided into several groups; a round insulating rod 6 is used as a heat dissipation oil path to separate two windings, an insulating positioning board 9 is used to secure the round insulating rod 6. The main function of the insulating block 7 and bending board 8 is to secure coils and circulate the oil paths; the oil path comprising the insulating block 7 and bending board 8 being to achieve the function of circulating oil and securing coils 5. Oil-return slots 10 constitute channels for oil return, coils being slipped over the core 11, and generating excitation to achieve the iron-absorption function of the Magnetic Separator, the magnetic paths being an open magnetic paths structure.

Figure 6:
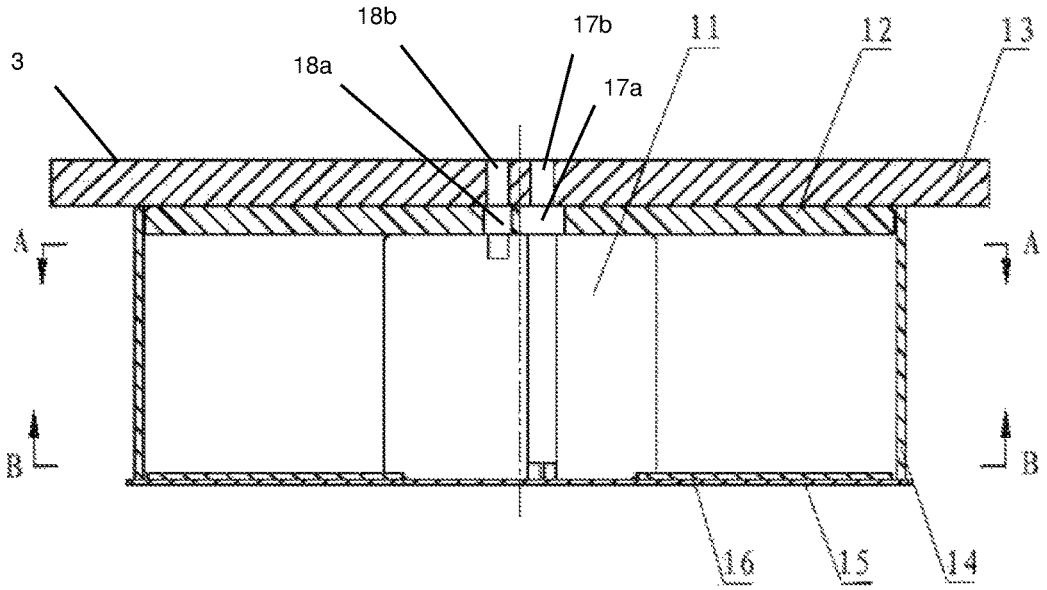
FIG. 6 is an internal sectional view of the internal-circulating oil path system in the high-gradient internal-circulating oil-cooled Magnetic Separator shown in FIG. 2.
Figure 7:
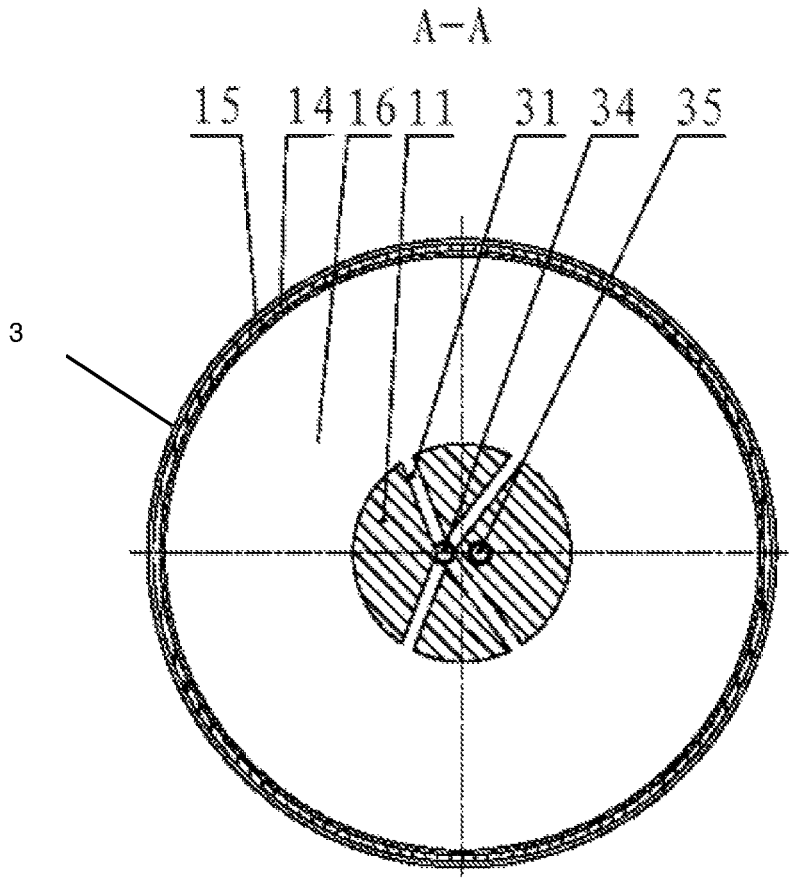
FIG. 7 is an A-A sectional view of the internal-circulating oil path system shown in FIG. 6.
Figure 8:
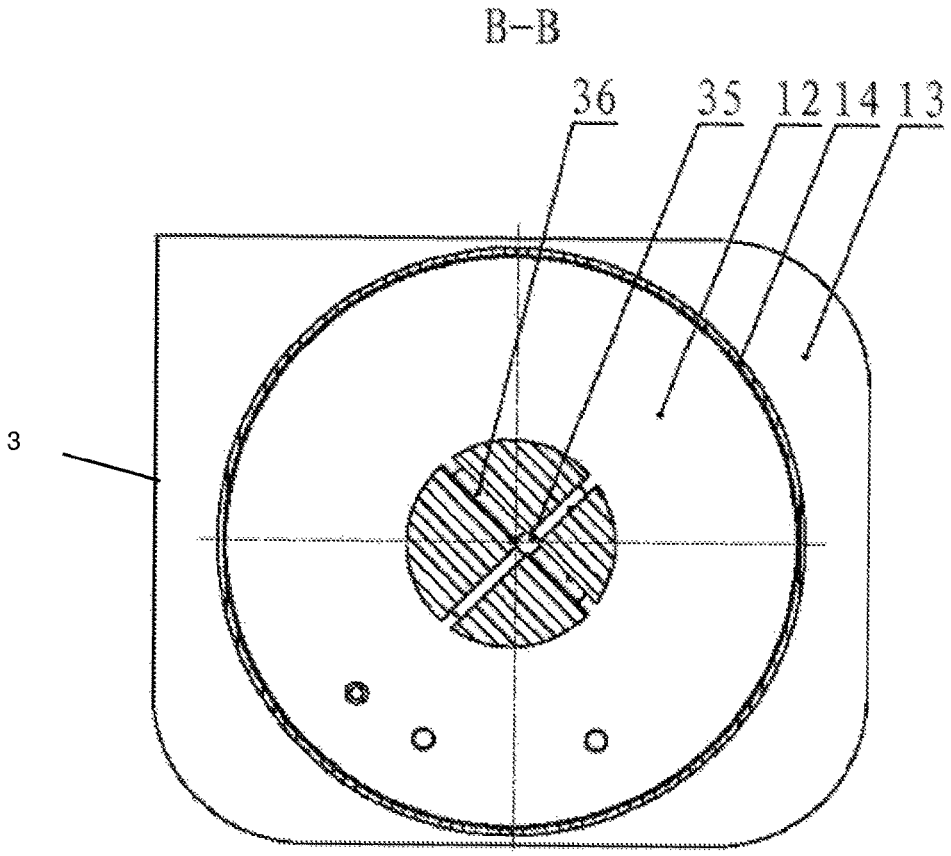
FIG. 8 is a B-B sectional view of the internal-circulating oil path system shown in FIG. 6.

As shown in FIG. 6-8, FIG. 6 is an internal sectional view of the internal-circulating oil path system 3; FIG. 7 is an A-A sectional view of the internal-circulating oil path system 3 shown in FIG. 6 as looking down at the core 11 from above; FIG. 8 is a B-B sectional view of the internal-circulating oil path system 3 shown in FIG. 6 as looking up at the core 11 from below. The internal-circulating oil path system 3 is used to achieve the function of allocation and collection circulation of the transformer oil. The configuration of the internal-circulating oil paths relates directly to the discretion of temperature rise and the strength of performance of the Magnetic Separator. The internal-circulating oil path system 3 comprises a core 11 (on which coils are wound), an oil conduit yoke plate 12, a large yoke plate 13, a magnet-conductive tube 14, a large supporting plate 15, and a supporting plate 16; wherein the core 11 is the key part to allocate and collect the transformer oil, the core 11 being at the middle position of the internal-circulating oil path system, the coils 5 being wound on the core 11, the core 11 directing the excitation provided by the coils 5 to the bottom of the Magnetic Separator to provide an open magnetic field for the Magnetic Separator. The oil conduit yoke plate 12 and the large yoke plate 13 are welded in sequence on the upper part of the core 11; magnetic lines above the core 11 are directed back to the core 11, increasing the magnetic field under the Magnetic Separator and decreasing flux leakage of the Magnetic Separator. The supporting plate 16 and the large supporting plate 15 are welded in sequence on the lower part of the core 11, taking part in securing the magnetic system. After coiling on the core in the magnetic system coils 4, the supporting plate 16 and the large supporting plate 15, the large yoke plate 13 and the oil conduit yoke plate 12 are welded to the magnet-conductive tube 14 to constitute a sealed container; an oil-inlet through-hole is set inside the core 11, radially diverging oil-collecting slots being formed on the upper and lower part of the core 11 by mechanical process. The large yoke plate 13 (also referred to as an outer yoke plate 13) has an oil-inlet hole **17*b* and an oil-return hole 18*b*, and the oil conduit yoke plate 12 (also referred to as an inner yoke plate 12) has an oil-inlet through hole 17*a* and an oil-outlet through hole 18*a*. The oil-inlet hole 17*b* of the large yoke plate 13 and the oil-inlet through hole 17*a* of the oil conduit yoke plate 12 connect with the oil-inlet hole or oil-injecting channel 35 of the core 11. The oil-return hole 18*b* of the large yoke plate 13 and the oil-outlet through hole 18*a* of the oil conduit yoke plate 12 connect with oil-collecting slots or oil-return paths 31 on the top of the core 11. The oil-inlet holes and oil-outlet holes of these parts are welded together after calibration. Transformer oil enters an oil-inlet through hole of the core 11 through the oil-inlet hole on the large yoke plate 13 and the oil-inlet hole on the oil conduit yoke plate 12, and then the transformer oil is injected into the coils 5 from the oil-collecting slots on the bottom of the core 11, moving bottom up to achieve heat dissipation of the coils 5. Transformer oils again is injected into the oil-return holes on the yoke plate 13 and the oil conduit yoke plate 12 through the oil-collecting slots above the core 11, and is injected again to the external-cooling system 2 to achieve heat dissipation of the coils. The inlet and outlet of the transformer oil in the core 11 is called internal-circulating oil path system 2**.

Figure 9:
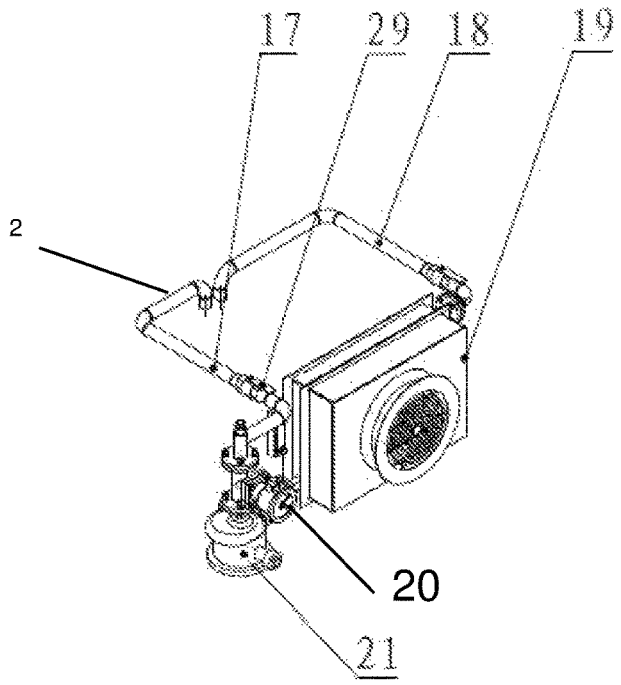
FIG. 9 is a structural schematic view of the external-cooling system in the high-gradient internal-circulating oil-cooled Magnetic Separator shown in FIG. 2.

FIG. 9 is a structural schematic view of the external-cooling system; the external-cooling system 2 acts mainly to dissipate heat of the transformer oil to achieve internal heat dissipation balance of the Magnetic Separator. The external-cooling system 2 comprises an oil pump 21 with a gauge 20 and a cooler 19, wherein the oil pump 21 connects with the oil-outlet tube 17 on one side, the other side of the oil pump 21 connecting with the cooler 19; the oil pump 21 is used for accelerating circulation of the transformer oil, enhancing the heat dissipation effect of the transformer oil to coils 5. The oil-outlet tube 17 connects with the oil-return hole of the large yoke plate 13 in the internal-circulating oil path system 2, the transformer oil in the oil-outlet tube 17 being injected into the cooler 19 by the oil pump 21, the other side of the cooler 19 connecting with the oil-inlet tube 18. Transformer oil is injected into the oil-inlet hole of the large yoke plate 13 in the internal-circulating system 2 through the oil-inlet tube 18 after being cooled by the cooler 19, and continues repeatedly to achieve heat dissipation of the coils 5.

Figure 10:
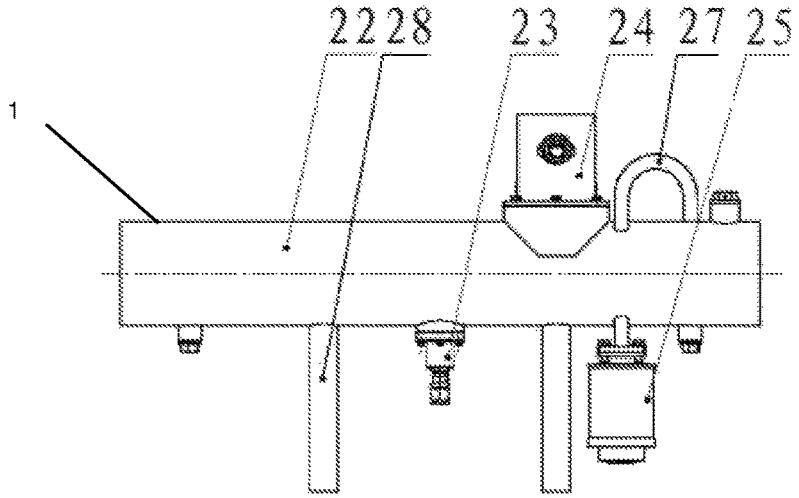
FIG. 10 is a structural schematic view of the oil conservator in the high-gradient internal-circulating oil-cooled Magnetic Separator shown in FIG. 2.
Figure 11:
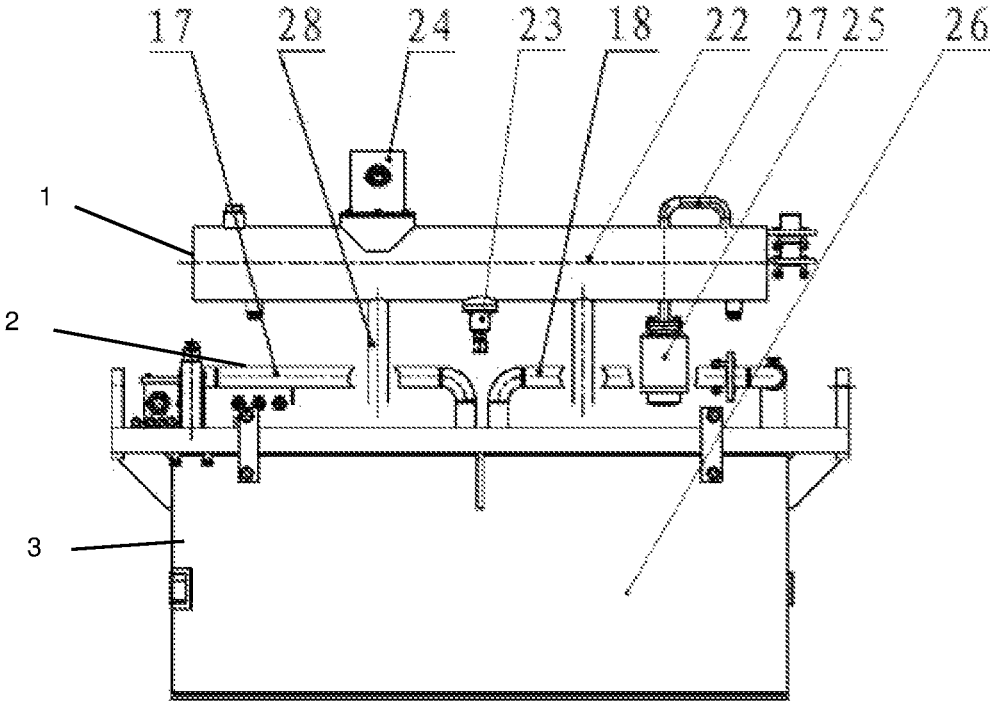
FIG. 11 is an external structural schematic view of the second embodiment of the high-gradient internal-circulating oil-cooled Magnetic Separator according to the invention.

FIG. 10 is a structural schematic view of the oil conservator. The oil conservator comprises an oil conservator body 22, a liquid level box 23, an excitation junction box 24, and a moisture absorber 25. The oil conservator 1 is used as a supplementary container for the transformer oil expansion during the apparatus's operation. The conservator body 22 connects with the oil paths of the Magnetic Separator through two vertical pipes, serving as an oil storage container of the oil conservator 1; the liquid level box 23 is located at the midpoint under the oil conservator 1, acting mainly to monitor the liquid level inside the oil conservator 1, achieving liquid level alerting through a floater liquid level switch, in case heat dissipation being effected by oil shortage of the Magnetic Separator. The excitation junction box 24 is located above the oil conservator 1, which stands on the same vertical line with the vertical pipe on one side. The excitation lines of the Magnetic Separator are connected with external cables, providing excitation for the Magnetic Separator. The excitation junction box 24 is located above the oil conservator 1, which on the one hand saving space, making the whole structure more concise, on the other hand, preventing to locate the junction box 24 under the liquid level of the transformer oil and reducing one oil leakage point. The moisture absorber 25 is located under the oil conservator 1, preventing transformer oil entering the moisture absorber. One bending tube is used to connect the moisture absorber with the conservator body 22, one side of the bending tube being deep into the conservator body 22, extracting water and humidity from the transformer oil, preventing mixing water into transformer oil, which will affect the insulation of the Magnetic Separator and at the same time, may also prevent deterioration of the transformer oil.

There are two circulating oil-cooled methods in the above mentioned high-gradient internal-circulating oil-cooled Magnetic Separator: internal circulation and external circulation.

First of all, the specific process of internal circulation is:

1. Transformer oil at low temperature comes from oil-inlet holes, transformer oil spraying out of the bottom of the core 11 after passing bottom up the core 11 in which an oil-inlet through hole exists, providing uniformly to the excitation coils 5 for heat exchange preparation;

2. Transformer oil enters uniformly multiple-layered winding coils 5 to start heat exchange bottom up;

3. Hot oil coming out of coils gaps is collected at the oil-return hole through the oil-collecting slots on the core 11, thus far accomplishing one heat exchanging internal-circulating oil-cooled process.

The design of the internal-circulating oil-path cooling system ensures primarily the structural uniformity of the transformer oil distribution, enhancing the efficiency of heat exchange, strengthening the cooling effect of the coils 5.

Secondly, the specific process of external-cooling is: The hot transformer oil coming out of the oil-outlet tube 17 of the external-cooling system backflows to the cooler 19, heat being dissipated to air by fans; accomplishing one complete circulation process.

A more detailed technical scheme, which may be combined together with the aforementioned high-gradient internal-circulating oil-cooled Magnetic Separator, may be acquired by reforming the first embodiment of the invention. In this technical scheme, transformer oil is injected into the large yoke plate 13, the oil-inlet hole of the oil conduit yoke plate 12 through the oil-inlet tube 18, then enters the core 11, an oil-inlet through hole being set inside the core 11, on the top and bottom of which radially diverging oil-collecting slots are formed by mechanically processing. Transformer oil circulated onto the core bottom flows to the coils bottom. Transformer oil moving bottom up achieves heat dissipation of the coils 5. Four oil-collecting slots are made on the upper part of the core 11, concentrating the hot oil after its circulation. Transformer oil passing the oil-outlet which is composed of the core 11, the large yoke plate 13 and the oil conduit yoke plate 12 circulates to the oil-outlet tube 17, and then being injected into the oil pump 21 to accelerate the transformer oil circulation, strengthening the heat dissipation effect of the transformer oil to coils 5, and internally circulates to the external-cooling system to dissipate heat, achieving internal heat dissipation balance inside the Magnetic Separator. Hot transformer oil is injected into the cooler 19 again by the oil pump 21, achieving the heat dissipation of the hot transformer oil. Cooled transformer oil after heat dissipation by the cooler is injected into the coils through the oil-inlet tube 18, repeatedly achieving the purpose of cooling the coils 5. Meanwhile, because the transformer oil expands when heated, the oil conservator 1 is used as a supplementary container for the transformer oil expansion during the apparatus's operation, and the oil conservator does not take part in the whole oil path circulation.

As shown in FIG. 11-15, the second embodiment of the invention is shown. This embodiment is another high-gradient internal-circulating oil-cooled Magnetic Separator of the invention. Among the rest, the high-gradient internal-circulating oil-cooled Magnetic Separator comprises a sealed shell 26 which is composed of a yoke plate, a supporting plate 15 and a magnet-conductive plate 14, and a magnetic system inside the shell 26. The magnetic system comprises a core 11 and coils 5 wound outside the core 11. The coils 5 are in a multi-layered structure, and an oil path 30 exists between one layer and another. The yoke plate comprises a large yoke plate 13 on the upper part and an oil conduit or small yoke plate 12 on the lower part. An oil-inlet tube 18 and an oil-outlet tube 17 and an oil conservator 1 are set on the large yoke plate 13. A valve 29 is set at the inlet of the oil-inlet tube 18 and the outlet of the oil-outlet tube 17. The external cooler and the circulating pump can be repaired by turning off the valve 29 during device maintenance, shortening the maintenance time and ensuring the production continuity of the Magnetic Separator. A junction or excitation junction box 24 of the coils 5 is set on the oil conservator 1. The oil conservator 1 is supported on the large yoke plate 13 through a vertical pipe 28 and connects with the internal chamber of the shell 26 through the vertical pipe 28. The oil conservator 1 may dampen the oil expansion when the temperature of the coils 5 rises. The oil conservator 1 connects at its lateral with a moisture absorber 25 through a connecting tube 27. With comparison to the traditional internal connection way that the moisture absorber 25 is located inside the hole of the oil conservator 1, this external connection way can effectively preventing oil leakage at the open holes of the oil conservator 1, simplifying the structure, being convenient for maintenance and renewal of the moisture absorber 25 and at the same time being convenient for viewing the color change of the moisture absorber 25, so as to make renewal in time. 4 radially distributed oil-return paths 31 are set at the middle of the oil conduit or small yoke plate 12. An oil collection hole 34 aggregated by the internal ends of the oil-return paths 31 connects with the oil-outlet tube 17; the external ends of the oil-return paths 31 together with their lateral connect the oil-collecting slots 33 that connects with the oil paths 30 through an oil-return hole 32. The oil-collecting slots 33 can plays a part in dampening, and making the transformer oil circulation more uniformly as well. Oil-injecting channels 35 and oil-inlet channels 36 are set respectively at the central position and bottom inside the core 11. Wherein the oil-inlet channels 36 are 4 channels forming a cross with each other, whose internal ends connects with the oil-injecting channels 35 and external ends connects with the oil paths 30.

Figure 12:
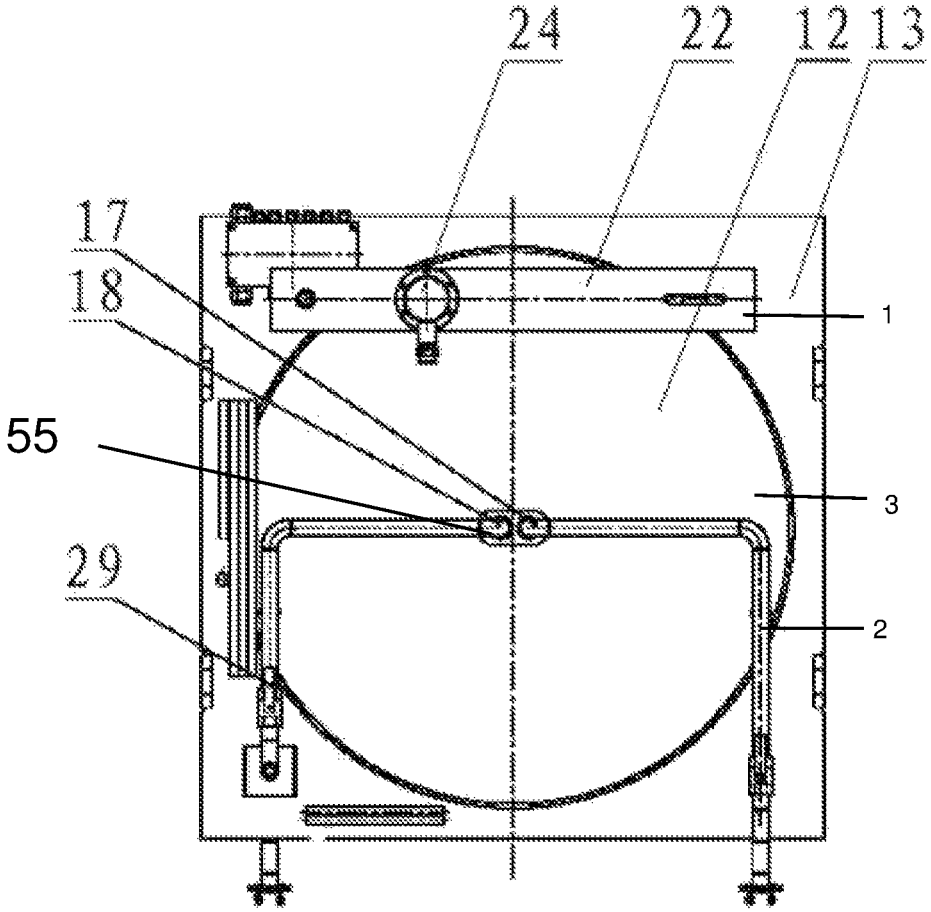
FIG. 12 is a top view of the high-gradient internal-circulating oil-cooled Magnetic Separator shown in FIG. 11.
Figure 13:
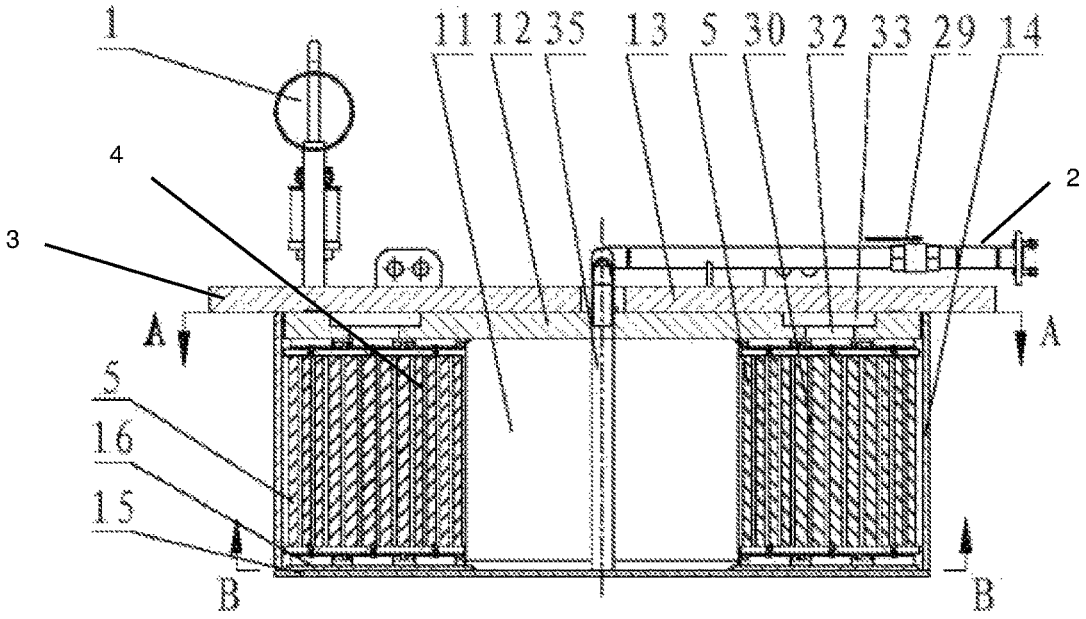
FIG. 13 is an internal structural schematic view of the second embodiment of the high-gradient internal-circulating oil-cooled Magnetic Separator according to the invention.
Figure 14:
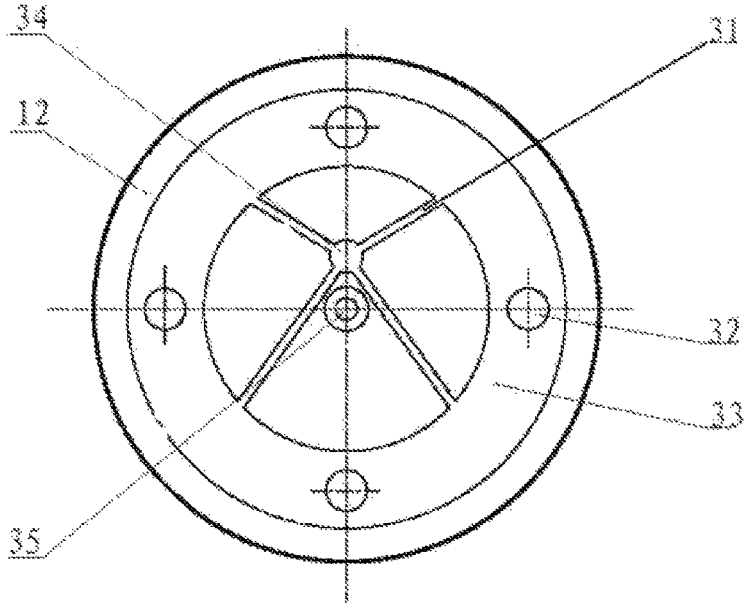
FIG. 14 is an A-A sectional view of the high-gradient internal-circulating oil-cooled Magnetic Separator shown in FIG. 13.
Figure 15:
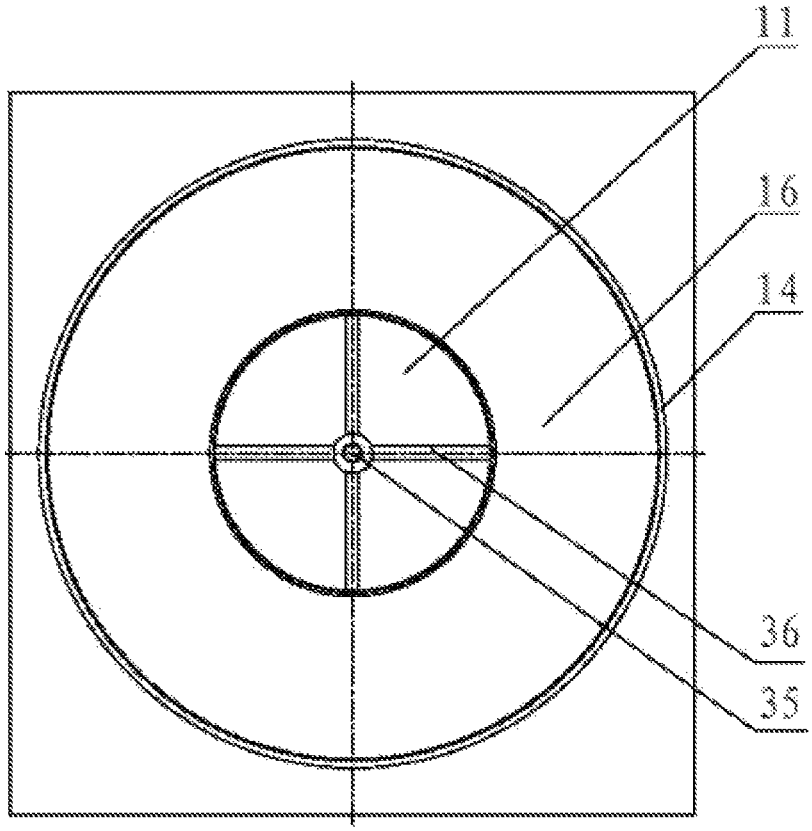
FIG. 15 is a B-B sectional view of the high-gradient internal-circulating oil-cooled Magnetic Separator shown in FIG. 13.

As shown in FIG. 11-15, the second embodiment of the invention is shown. This embodiment is another high-gradient internal-circulating oil-cooled Magnetic Separator of the invention. Among the rest, the high-gradient internal-circulating oil-cooled Magnetic Separator comprises a sealed shell 26 which is composed of a yoke plate, a supporting plate 15 and a magnet-conductive plate 14, and a magnetic system inside the shell 26. The magnetic system comprises a core 11 and coils 5 wound outside the core 11. The coils 5 are in a multi-layered structure, and an oil path 30 exists between one layer and another. The yoke plate comprises a large yoke plate 13 on the upper part and a small yoke plate 12 on the lower part. An oil-inlet tube 18 and an oil-outlet tube 17 and an oil conservator 1 are set on the large yoke plate 13. A valve 55, in FIG. 12, is set at the inlet of the oil-inlet tube 18 and the outlet of the oil-outlet tube 17. The external cooler and the circulating pump can be repaired by turning off the valve 55 during device maintenance, shortening the maintenance time and ensuring the production continuity of the Magnetic Separator. A junction box 24 of the coils 5 is set on the oil conservator 1. The oil conservator 1 is supported on the large yoke plate 13 through a vertical pipe 28 and connects with the internal chamber of the shell 26 through the vertical pipe 28. The oil conservator 1 may dampen the oil expansion when the temperature of the coils 5 rises. The oil conservator 1 connects at its lateral with a moisture absorber 25 through a connecting tube 27. With comparison to the traditional internal connection way that the moisture absorber 25 is located inside the hole of the oil conservator 1, this external connection way can effectively preventing oil leakage at the open holes of the oil conservator 1, simplifying the structure, being convenient for maintenance and renewal of the moisture absorber 25 and at the same time being convenient for viewing the color change of the moisture absorber 25, so as to make renewal in time. 4 radially distributed oil-return paths 31 are set at the middle of the small yoke plate 12. An oil collection hole 34 aggregated by the internal ends of the oil-return paths 31 connects with the oil-outlet tube 17; the external ends of the oil-return paths 31 together with their lateral connect the oil-collecting slots 33 that connects with the oil paths 30 through an oil-return hole 32. The oil-collecting slots 33 can plays a part in dampening, and making the transformer oil circulation more uniformly as well. Oil-injecting channels 35 and oil-inlet channels 36 are set respectively at the central position and bottom inside the core 11. Wherein the oil-inlet channels 36 are 4 channels forming a cross with each other, whose internal ends connects with the oil-injecting channels 35 and external ends connects with the oil paths 30.

Beneficial Effects

Compared with the technical effects acquired by the Magnetic Separators in the prior art, huge improvements have been made to the circulating oil path structure of the high-gradient internal-circulating oil-cooled Magnetic Separator of the invention, which mainly lies in:

1. Existing Circulating Oil Path Structure in Circulating Oil-Cooled Magnetic Separators (1) The allocation of oil flows is not uniform, affecting heat dissipation: Existing circulating oil path structure of circulating oil-cooled Magnetic Separators is of the single-input-single-output type, the outlets of transformer oil being allocated on the magnet-conductive tube, the inlets being allocated on the lateral of the magnet-conductive tube. This structural oil path results in the single-in and single out transformer oil, and the oil flows non-uniformly. Because the gap between the external layer windings of the magnetic system coils and the wall of the magnet-conductive tube is large, the resistance of the oil flow is relatively small, the transformer oil flow speed being relatively fast, the heat dissipation being relatively good; however, because the windings of the magnetic system coils close to the hottest position of the core are far from the inlet and outlet of the transformer oil, the transformer oil flows slow and dissipate heat not that well, resulting in bad heat dissipation effect, the temperature rise of the coils, and the deterioration of the performance.

(2) Because the inlet and outlet of the transformer oil of the existing circulating oil-cooled Magnetic Separators must be arranged on both sides of the Magnetic Separators, making the pipeline from the cooler to the inlet and outlet longer and requiring more bends be added to the pipelines to prevent interference with other parts of the device. Such a structure results in larger resistance in pipelines, more welding parts on the pipelines and easy leakage.

2. The Circulating Oil Path Structure of the Circulating Oil-Cooled Magnetic Separator of the Invention (1) An internal-circulating oil path structure is employed in the invention. Unique core structure plays a part in allocating uniformly the transformer oil: Transformer oil is provided uniformly from oil slots on the central bottom of the core of the Magnetic Separator to the peripherally external, hot oil being collected peripherally from the oil slots on the upper part of the core of the Magnetic Separator. Inlet and outlet of the transformer oil are arranged uniformly on the large yoke plate of the Magnetic Separator, making the structure concise. The structure results in multiple-in-multiple-out transformer oil and uniform oil flow. Transformer oil flows smoothly and dissipates well, the heat dissipation effect being good, the temperature rise of coils being low, the performance being enhanced.

(2) Because the inlet and outlet of the transformer oil are arranged uniformly on the large yoke plate of the circulating oil-cooled Magnetic Separator in the invention, the pipelines being short, preventing more bends in pipelines, avoiding interference with other parts of the device, the resistance in pipelines being small, the welding parts on the pipelines being decreased substantially, avoiding potential accidents of welding leakage.

(3) This internal-circulating structure makes the oil paths circulation more uniform and reasonable, decreasing effectively the temperature rise of the Magnetic Separator, ensuring the temperature rise be under 40° C., enhancing performance of the Magnetic Separator, making its performance much higher than the industrial standard. In addition, an oil-inlet through hole is set in the core, and the core may be cooled when oil is injected, making the whole heat dissipation effect of the whole Magnetic Separator better. The structure in the invention is simple, the design being reasonable, making it convenient for maintenance. The invention fills in gaps in Magnetic Separators of this kind, leads at an advanced level of the oil-cooled Magnetic Separators, and is worthy of application and dissemination.

The above is only preferred specific embodiments of the invention; however, the scope of protection of the invention is not limited to this. Any modification or substitution that is easy to conceive by a person skilled in the art within the technical scope disclosed in the invention should be included in the scope of protection of the invention. It should be understood by an ordinary person in the art that any variety of modification could be made in format and detail without departing from the spirit and scope of the invention defined by the appended claims.

We claim:

1. A high-gradient magnetic separator with internal oil cooling, the separator comprising:

a magnetic system generating an excitation magnetic field so as to form magnetic paths in an open magnetic path structure, said magnetic system having an iron-absorption function, wherein said magnetic system comprises:

a plurality of coils formed into windings, said coils being energized for magnetic separation and forming oil paths between said adjacent windings;

a round insulating rod being spaced between adjacent windings of a respective coil and supporting said oil paths between said adjacent windings;

an insulating positioning board securing said round insulating rod;

an insulating block being aligned with said round insulating rod and securing said coils relative to said oil paths; and a bending board being cooperative with said insulating block so as to secure said windings of said coils and circulating oil paths;

an internal circulation system in fluid connection with said oil paths of said magnetic system, wherein said internal circulation system comprises:

a core, inserted through said coils of said magnetic system, said core having a top and a bottom, and being cooperative with said coils so as to generate said excitation magnetic field, said core being in fluid connection with said oil paths of said magnetic system, wherein magnetic lines above said core are directed back to said core so as to increase magnetic field strength and decrease flux leakage, wherein said core comprises:

an oil-injecting channel extending from said top of said core to said bottom of said core;

a plurality of oil-inlet channels on said bottom of said core, said oil-inlet channels being in fluid connection with said oil-injecting channel and radiating outward from said oil-injecting channel inside said core, said oil-inlet channels being in fluid connection with said oil paths of said magnetic system;

a plurality of oil-return paths on said top of said core, said oil-return paths being in fluid connection with said oil-inlet channels through said oil paths of said magnetic system; and an oil-collecting hole extending from said oil-return paths to said top of said core, said oil-return paths being in fluid connection with said oil-collecting hole and radiating outward from said oil-collecting hole, said oil-collecting hole being in fluid connection with said oil-injecting channel through said oil-inlet channels, said oil paths of said magnetic system and said oil-return paths;

an inner yoke plate having an oil-inlet through hole and an oil-outlet through hole, said oil-inlet through hole being in fluid connection with said oil-injecting channel, said oil-outlet through hole being in fluid connection with said oil-collecting hole, said inner yoke plate being welded to an upper part of said core;

an outer yoke plate having an oil-inlet hole and an oil-return hole, said oil-inlet hole being in fluid connection with said oil-injecting channel and said oil-inlet through hole, said oil-return hole being in fluid connection with said oil-collecting hole and said oil-outlet through hole, said outer yoke plate being welded to said inner yoke plate opposite said core, said inner yoke plate being between said core and said outer yoke plate;

an inner supporting plate welded to a lower part of said core;

an outer supporting plate welded to said inner supporting plate opposite said core; and an outer tube being magnetically conductive and connecting said inner yoke plate, said outer yoke plate, said inner supporting plate, and said outer supporting plate so as to form a sealed container housing said magnetic system;

an external-cooling system having an oil-inlet tube and an oil-outlet tube, said oil-outlet tube being in fluid connection with said oil-inlet hole of said outer yoke plate, said oil-inlet through hole of said inner yoke plate, and said oil-injecting channel, said oil-inlet tube being in fluid connection with said oil-outlet hole of said outer yoke plate, said oil-outlet through hole of said inner yoke plate, and said oil-collecting hole; and an oil conservator having a plurality of pipes in fluid connection with oil paths of said magnetic system, said internal circulation system, and said external-cooling system, said oil-outlet tube of said external-cooling system being in direct fluid connection to said internal circulation system, said oil conservator being comprised of a supplementary container, wherein said oil-outlet tube of said external-cooling system, said oil-inlet hole of said outer yoke plate, said oil-inlet through hole of said inner yoke plate, said oil-injecting channel of said core, said oil-inlet channels of said core, said oil paths of said magnetic system, said oil-return paths of said core, said oil-collecting hole of said core, said oil-outlet through hole of said inner yoke plate, said oil-outlet hole of said outer yoke plate, said oil-inlet tube being in fluid connection form a flow path so as to circulate transformer oil along said flow path with heat dissipation of said coils in said oil paths of said magnetic system, said external-cooling system dissipating heat of said transformer oil from said coils.

2. The high-gradient magnetic separator, according to claim 1, wherein said external-cooling system further comprises:

a cooler being in fluid connection to said oil-inlet tube and said oil-outlet tube, said cooler having an input and an output; and an oil pump connected to said cooler, wherein said oil-outlet tube is in fluid connection to said output of said cooler, wherein said oil-inlet tube is in fluid connection to said input of said cooler, wherein said oil pump accelerates circulation through said flow path so at to enhance heat dissipation, and wherein said cooler reduces temperature of flow in said oil-inlet tube, said flow pumped through said cooler having a lower temperature in said oil-outlet tube.

3. The high-gradient magnetic separator, according to claim 1, wherein said oil conservator further comprises:

an oil conservator body forming said supplementary container and being in fluid connection with said pipes;

a liquid level box, being located at a midpoint of said oil conservator body and underneath said oil conservator body and having a floater liquid level switch;

an excitation junction box being located above said oil conservator body; and a moisture absorber being located underneath the oil conservator and having a bending tube in fluid connection with said oil conservator body, said bending tube having one end inside said oil conservator body and another end connected to said moisture absorber, wherein said flow path further comprises said oil conservator body between said oil-inlet tube at said oil-outlet hole of said outer yoke plate and said oil-outlet tube so as to store expanded flow heated by said coils.

4. The high-gradient magnetic separator, according to claim 1, wherein said inner yoke plate of said internal circulation system further comprises:

a plurality of oil-return holes aligned above said coils; and a plurality of oil-collecting slots in fluid connection with said oil-return holes and said oil-return paths of said core, wherein said flow path further comprises said oil paths of said magnetic system, said oil-return holes, said oil-collecting slots, and said oil return paths of said core.

* * * * *